US005407084A

United States Patent [19]

Remmers

[11] Patent Number: 5,407,084

[45] Date of Patent: Apr. 18, 1995

[54] GLIDE RUNNER SUPPORT

[75] Inventor: Lee E. Remmers, Ocala, Fla.

[73] Assignee: Vermont American Corporation, Louisville, Ky.

[21] Appl. No.: 55,529

[22] Filed: Apr. 30, 1993

[51] Int. Cl.[6] ..... A47F 5/00

[52] U.S. Cl. ..... 211/183; 211/162; 211/182; 403/237; 403/235; 108/193; 312/334.23

[58] Field of Search ..... 211/182, 41, 86, 88, 211/107, 126, 133, 151, 162, 181, 183; 403/237, 235, 236, 234; 108/157, 183, 187; 312/330.1, 334.23

[56] References Cited

U.S. PATENT DOCUMENTS

| | | | |
|---|---|---|---|
| 1,974,983 | 9/1934 | Look | 312/330.1 X |
| 2,758,455 | 8/1956 | Anderson . | |
| 2,946,458 | 7/1960 | DuBoff et al. . | |
| 2,971,655 | 2/1961 | Duboff et asl. . | |
| 3,175,697 | 11/1963 | Kelly . | |
| 3,176,848 | 4/1965 | Stefan | 211/181 X |
| 3,655,063 | 4/1972 | Laudry . | |
| 3,714,513 | 1/1973 | Marconi | 211/41 X |
| 3,747,885 | 7/1973 | Ciancimino | 211/182 X |
| 4,004,819 | 1/1977 | Brongo | 211/181 X |
| 4,253,224 | 3/1981 | Hickman et al. | 403/237 X |
| 4,552,415 | 11/1985 | Fulterer | 312/330.1 X |
| 4,588,096 | 5/1986 | Story et al. | 280/79.3 X |
| 4,795,041 | 1/1989 | Remmers | 312/334.23 X |
| 4,887,538 | 12/1989 | Arnold | 211/182 X |
| 4,904,032 | 2/1990 | Jenkins . | |
| 4,984,694 | 1/1991 | Magnusson | 211/133 X |
| 4,995,682 | 2/1991 | Gutuer . | |
| 5,105,953 | 4/1992 | Finnegan . | |
| 5,257,701 | 11/1993 | Edelson | 108/193 X |
| 5,294,009 | 3/1994 | Maurer et al. | 211/126 |

FOREIGN PATENT DOCUMENTS

| | | | |
|---|---|---|---|
| 2625421 | 7/1989 | France | 312/249.11 |

*Primary Examiner*—Blair M. Johnson
*Attorney, Agent, or Firm*—Middleton & Reutlinger; James C. Eaves, Jr.

[57] ABSTRACT

The glide runner support of the present invention is comprised of a pair of longitudinal members, spaced apart and aligned parallel with one another, each one being formed having a centrally located longitudinal interior channel extending the length thereof with a stop at one end. A holding bracket forming "C-shaped" flanges is integrally formed on each end of the longitudinal members for attachment of a support frame. A container such as a drawer, wire basket, or other organizer container having a pair of support members extending therefrom, such as a pair of support rods or lips, slidably engage the longitudinal interior channels of the longitudinal members.

The glide runner support is designed with the longitudinal members being bowed slightly inward so that the application of external pressure, such as is generated by a heavy object held within the organizer, creates tension between the container support members and the longitudinal interior channels; thereby resulting in a trussing effect by the support members against the longitudinal interior channel walls to control the sliding movement of the container. Interaction of the stop member within the longitudinal interior channels of the longitudinal members limit the reciprocating movement of the container within the glide runner support.

19 Claims, 4 Drawing Sheets

GLIDE RUNNER SUPPORT

BACKGROUND OF THE INVENTION

Conventional cabinet and closet drawer organizers have relatively long carriers for containers, such as drawers or wire baskets to hold objects for storage. Items placed at the back of the organizer drawers are often difficult to reach, and sometimes items within the drawer must be removed to reach a particular item, or a drawer must be removed in order to remove the item. Shelving manufacturer's have attempted to solve the problem by installing complicated rail and roller systems to support and guide the container within a support frame so that an upper drawer may be slidably moved to expose the contents of the lower drawer. Existing systems usually consist of track elements integrally formed within the sides of the drawers. These conventional systems are designed for a particular drawer or frame, noninterchangeable, and usually consists of several moving parts which wear out causing binding of the movable support system. Replacement of a track system, or installation of a track system within a drawer having no track system requires precise measurement and location of the track components.

Hence, the shelving and drawer industry has for many years attempted to provide a solution to provide easier access for the user to hard to reach storage areas. For instance, U.S. Pat. No. 2,946,458 shows a reciprocating tray unit in the form of a wire basket made from rods, wherein the tray or basket is mounted on loops which pass over and around the rails of base member so as to reciprocate thereon. U.S. Pat. No. 4,025,013 shows a base support platform having an extension leg for a dish drainer. U.S. Pat. No. 5,367,218 shows a basket frame formed of wire members adapted to rest in and slide along L-shaped tracks. U.S. Pat. No. 3,082,879 shows a receptacle of wire rod construction forming a tray wherein the bottom of the receptacle has wire rod loops welded to the under side of rods. Moreover, U.S. Pat. No. 3,114,459 teaches a record holding file having an open framework formed of rods and a bottom rail supported on tracks. Furthermore, U.S. Pat. No. 4,913,298 shows an extractable carriage formed of a tray mounted on supporting frames which slide on tracks. Yet another reference, U.S. Pat. No. 2,971,655 shows a conventional reciprocating tray formed of wire elements and adapted to slide in a guide via rollers.

The glide runner support system of the present invention provides a means for reciprocal movement of a containers or other such organizers closer to the user with a minimum of effort, and to hold the organizer at a desired location without the user having to engage any type of special stop or latch means. Moreover, the present invention can be utilized in existing frame support systems or with simple and inexpensive tubular frames. Furthermore, the present support glide runner system has interchangeable members and is readily adaptable for supporting multi-layer container units.

SUMMARY OF THE INVENTION

The present invention relates to a glide runner support system having a pair of longitudinal members mounted to a vertical or horizontal frame by brackets integrally formed on the distal end of the longitudinal members. A wire basket, drawer, or other organizer is slidably supported within longitudinal channels formed within the longitudinal members. The glide runner supports are designed so that flexing the support members extending from the container slidably supported within the channels creates a trussing effect increasing the friction to control the sliding movement and reciprocation of the container within the glide runner supports.

Accordingly, it is an object of the present invention to provide a glide runner support which eliminates rolling parts such as wheels and does not require additional mechanical assemblies such as bearings.

It is another object of the present invention to provide a glide runner support having built in stop means to limit the movement of a container in the pushed-in closed position.

It is yet another object of the glide runner support to design the glide runner support whereby the container units can be removed therefrom by simply pulling the container forward toward the user.

Moreover, it is an object of the present invention to design glide runner support system providing a means for the organizer unit to be installed within the glide runner supports by simply inserting the container lip or rod support members within the longitudinal interior channel of the glide runner support.

It is yet another object of the present invention to provide a glide runner support which can be manufactured from either metal, wood, or plastic and adapted for installation utilizing a support frame having either round or square tubing.

It is still another object of the present invention to provide a glide runner support having a low profile in order to maximize usable space within an existing support frame, and provide a decorative appearance.

A further object of the present invention is to utilize longitudinal members for the glide runner support which are symmetrical, in order to simplify installation of the longitudinal members within a drawer or frame support by merely aligning the longitudinal members parallel to one another, and spaced the proper distance apart from one another.

These objectives are accomplished by the glide runner support comprising a pair of longitudinal members having a longitudinal interior channel extending the length thereof, and means for attachment of the longitudinal members in spaced relationship to a support structure for supporting a container having a means for support extending therefrom, movably slidably retained in cooperative relationship within the longitudinal interior channel of the longitudinal members.

More particularly, each glide runner support comprises a longitudinal member of unitary construction formed being bowed slightly inward and having an irregular cross-section and distal end holding brackets "C-shaped flanges". The longitudinal members are spaced apart and aligned parallel an equal distance opposite one another in a frame having tubular or square leg members. The generally "C-shaped" holding brackets on the distal ends of each longitudinal member are attached to the inside of the frame legs by screws. A reinforcement rib extends along the top and bottom of each member, and an interior, centrally located, longitudinal channel extends the length of the member. The longitudinal members may be provided with a stop means such as a lip filling the longitudinal channel at one end of the member to limit movement of the wire basket or drawer type container within the glide runner support. The longitudinal interior channels of each of the glide runner supports are positioned facing inward, toward each other. The longitudinal interior channels slidably support the outer lip of a container or the arm formed by the wire basket support rods which extend around the periphery of a wire basket.

To use the glide system, the container support members are slidably held within the channels of the glide runner supports. The glide runner support utilizes a novel means to control the sliding movement of the organizer support member within the longitudinal interior channels of the longitudinal member. A trussing effect is created when downward weight is applied to the container support members supported within the interior channels of the glide runner support. Application of external pressure, such as generated by the user or a heavy object held within the organizer, creates a trussing effect, wherein the downward pressure on the organizer support members causes the glide runner supports to flex. Flexing of the longitudinal members of the glide runner support provides a means to control the sliding reciprocating movement of the container and hold the container within the glide runner supports.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

Figure 1:
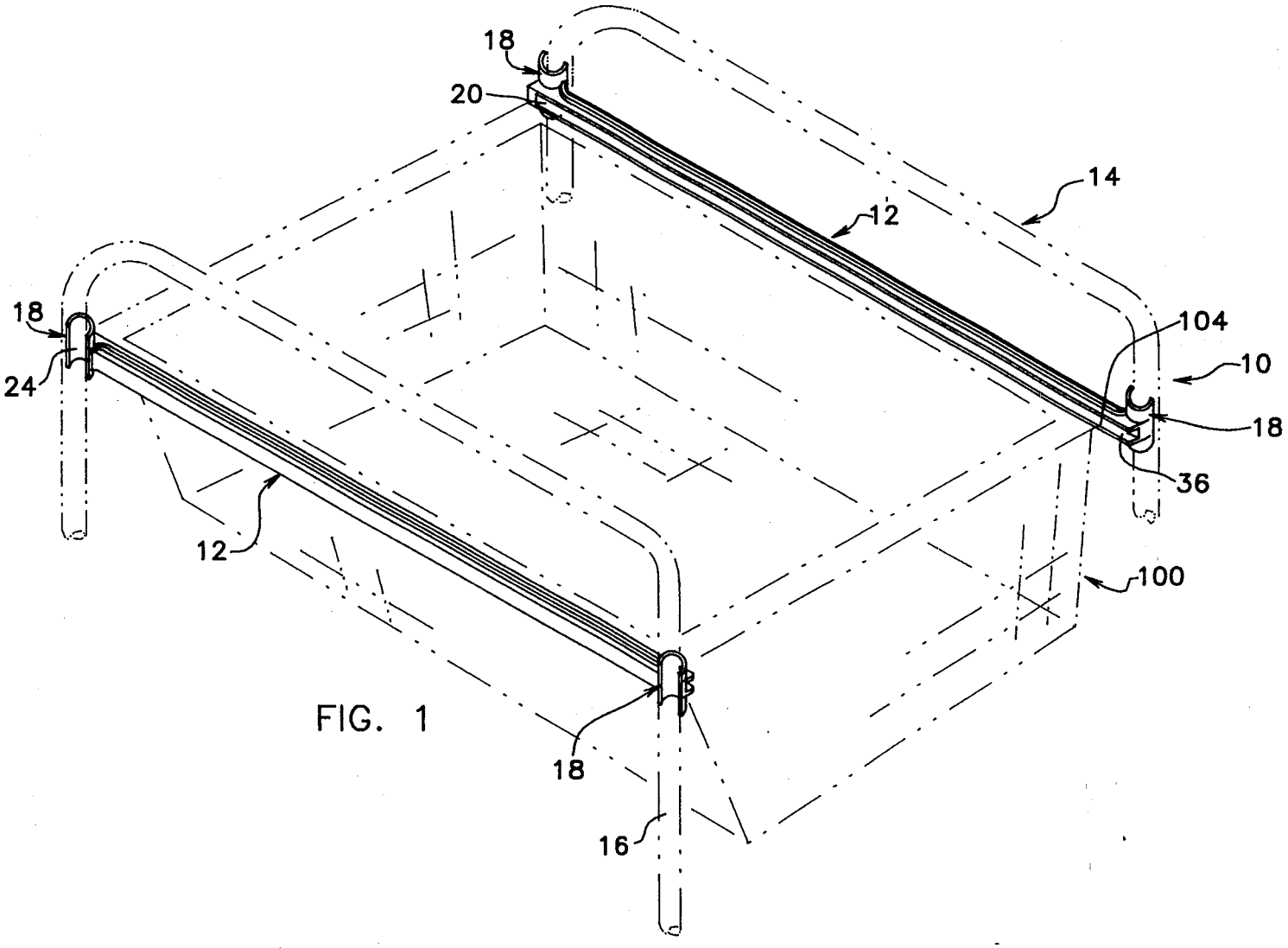
FIG. 1 is a perspective view of the glide runner support system of the present invention showing a wire basket organizer, shown in phantom lines, slidably supported by a pair of longitudinal members mounted to the vertical support members of a frame shown in phantom lines.

In accordance with FIG. 1, the organizer 100, shown in phantom lines, is formed from steel wire rods crisscrossed to form a wire basket container. The means for support for the organizer basket 100 comprises at least one projection extending from each side of the organizer 100, such as a plurality of tabs or rod members. As shown in FIG. 1, the organizer 100 includes a pair of horizontal side support rods defining a pair of runners 104 extending the length thereof.

Figure 2:
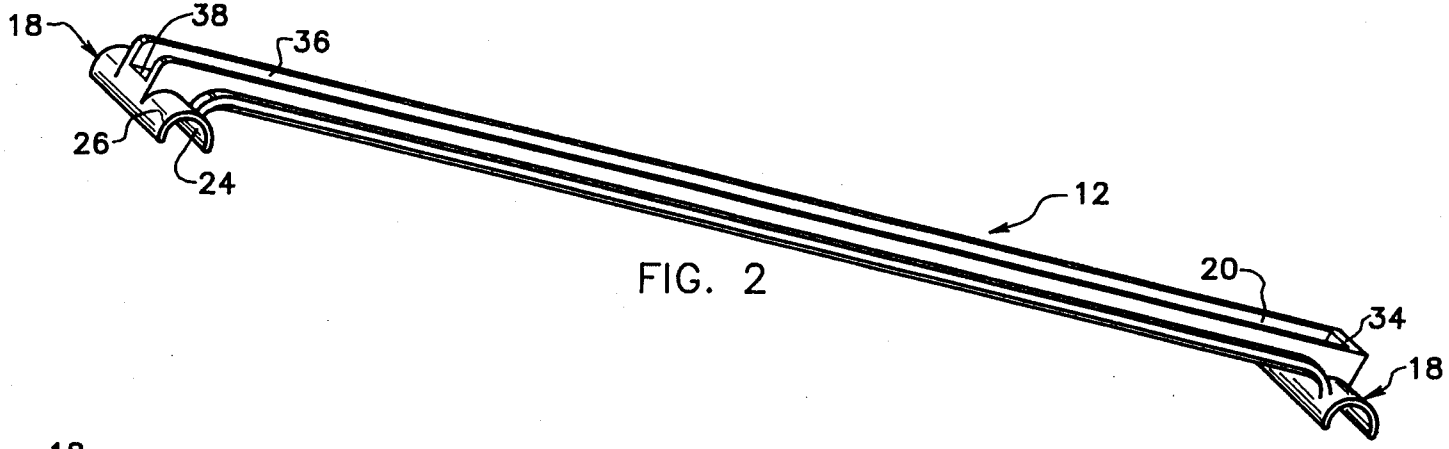
FIG. 2 is a perspective view showing a longitudinal member of the glide support runner of FIG. 1.
Figure 3:
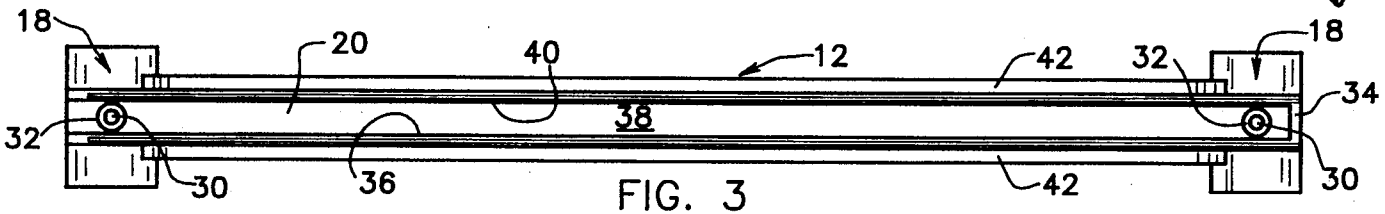
FIG. 3 is an inside view showing the longitudinal interior channel formed within the longitudinal member of FIG. 1.

As shown in FIGS. 1, 2, and 3, the glide runner support 10 comprises a longitudinal member 12 of unitary construction having an irregular cross-section. The thickness of the longitudinal members 12 are determined according of the size and weight of the contents for which the glide runner support 10 is designed. The glide runner support 10 of the present invention can be fabricated from wood, cardboard, plastic, metal, plastic coated metal, or any combination thereof. The longitudinal members 12 forming the glide runner support 10 shown in the preferred embodiment are molded from plastic.

The glide runner support system 10 of the preferred embodiment is comprised of a pair of longitudinal members 12 removably mounted to a frame 14. As shown in the preferred embodiment, the frame 14 is shown in phantom lines having spaced apart horizontal and vertical support members 16. The longitudinal members 12 of the glider runner support 10 are spaced apart, and aligned parallel and opposite one another, and mounted to the vertical support members 16. The wire basket, drawer, or other organizer 100 is slidably supported by the longitudinal members 12.

An interior, generally centrally located, longitudinal channel 20, or "track" extends continuously along the longitudinal member 12. The longitudinal interior channels 20 of each of the glide runner supports 10 are positioned in alignment facing inwardly, toward each other. The longitudinal interior channels 20 are adapted to accommodate the means for support 104 extending from the organizer 100 in cooperative relationship movably retained within the longitudinal interior channel 20 of each of the longitudinal members 12. As shown in FIG. 1, the longitudinal interior channels 20 slidably supports the runner 104 of the organizer 100 which extend around the periphery of the organizer 100.

Furthermore, the longitudinal interior channels 20 are sized to provide a complimentary slip fit with the organizer support means 104 extending from the container 100. As shown best in FIGS. 2–4, and 5 each channel 20 is formed having a generally rectangular cross-sectional shape defining a generally flat smooth bottom channel surface 36, side channel surface 38, and top channel surface 40.

Figure 6:
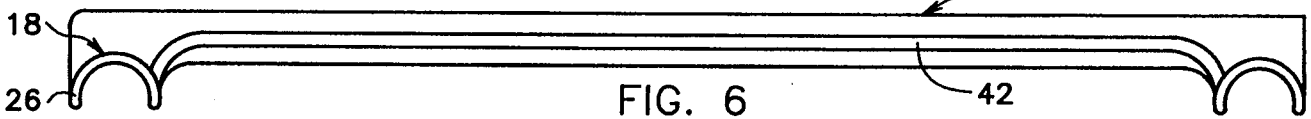
FIG. 6 is a top or bottom view of the longitudinal member of FIG. 1.
Figure 7:
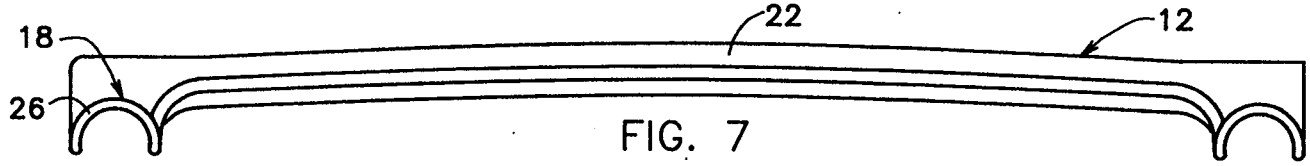
FIG. 7 is a top view showing an inwardly bowed longitudinal member of the present invention.
Figure 11:
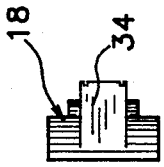
FIG. 11 is a rear end view of the longitudinal member of FIG. 1 showing the stop means within the longitudinal interior channel.
Figure 4:
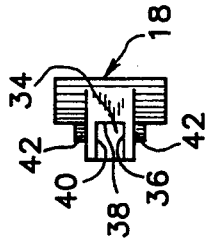
FIG. 4 is a front end view of the longitudinal member of FIG. 1 showing the longitudinal interior channel therein.

As shown in FIGS. 6, the longitudinal member 12 of the preferred embodiment is generally straight; however, as illustrated in FIG. 7, the longitudinal members 12 of the glide runner support 10 may be formed having a slight bowed portion 22 bending inwardly toward one another for exerting frictional tension on the runners 104 of the organizer 100 slidably supported within the longitudinal interior channel 20 thereby creating a trussing effect providing the user with control and "feel", of the reciprocating movement of the container 100 movably supported therein. Moreover, the trussing effect provides a means to control the speed and extent of reciprocation of the organizer 100 within the longitudinal interior channels 20 preventing the runners 104 and organizer 100 from jumping out of the longitudinal interior channel 20.

The glide support runners 10 of the preferred embodiment are formed from plastic and naturally have elasticity or "memory" so that the tension provided by the bow 22 is indefinite and lasts for the lifetime of the invention. The flexible feature of the longitudinal member 12 is an important feature of the present invention not incorporated in prior art devices, for the glide runner support 10 is designed to provide limited flexible support and guide means for the runner 104 within the channel 20 during use.

The longitudinal members 12 of the preferred embodiment include a stop means 34 at one end of the longitudinal interior channel 20 to limit movement of the organizer 100 within the longitudinal interior channel 20 of the glide runner support 10. FIGS. 2–4 and 8, 9, and 11, show the stop means 34 as a member integrally formed within the longitudinal interior channel 20 of the longitudinal member 12 to provide additional structural support to the glide runner support. However, the stop means 34 may be defined by a lip, screw, or other projecting or plugging device extending into at least a portion of the longitudinal interior channel 20. However, a stop means is not essential for use of the glide runner support system 10, for the tension created by the bow 22 enables the user to slide the organizer 100 to the desired position along the glide runner support 10.

Figure 12:
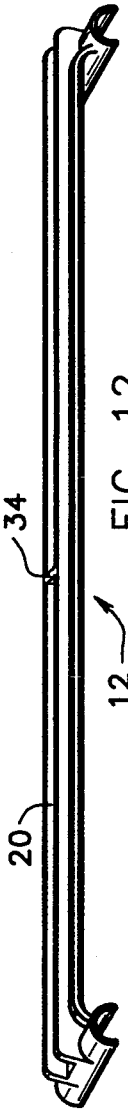
FIG. 12 is a perspective view showing an alternate embodiment of the longitudinal member shown in FIG. 1, having a centrally located stop means with the longitudinal interior channel being open at both ends.
Figure 5:
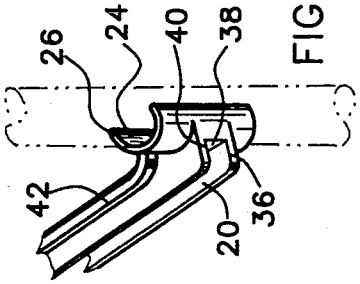
FIG. 5 is a front end perspective view showing mounting of a bracket of the longitudinal member to a tubular frame support member shown in phantom lines.
Figure 8:
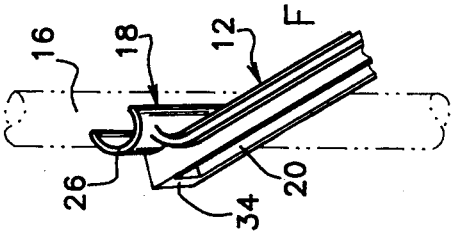
FIG. 8 is a rear end perspective view showing mounting of a bracket of the longitudinal member to a tubular frame support member shown in phantom lines, and showing the stop means within the longitudinal interior channel.

Furthermore, the stop means 34 may be positioned at other than one end of the longitudinal member 12. For instance, a glide runner support system 10 for a long cabinet sharing a dividing wall may be comprised of longitudinal members 12 having a centrally located stop means 34, wherein organizers 100 may be inserted in both ends of the longitudinal interior channels 20 of the longitudinal members 12, such as shown in FIG. 12.

Figure 13:
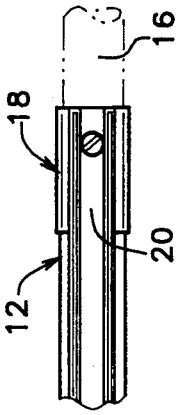
FIG. 13 is a side view showing a bracket having the flange oriented in horizontal alignment with the longitudinal member.
Figure 14:
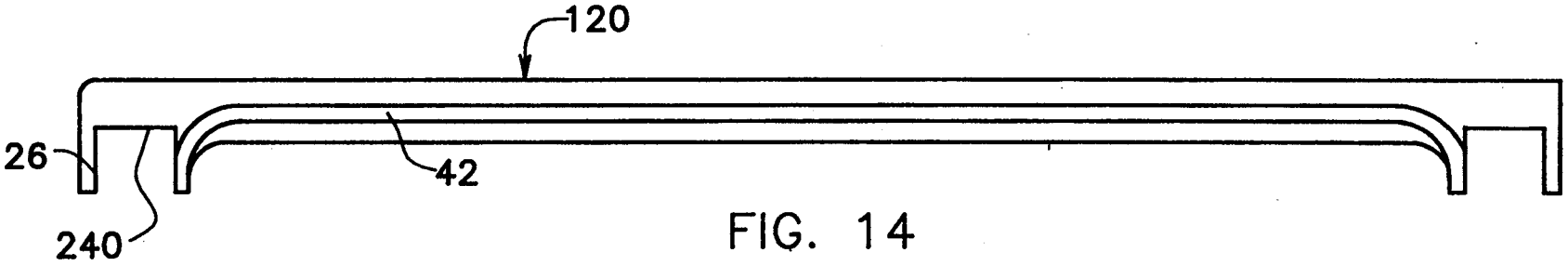
FIG. 14 is a top view showing an alternative glide runner support having a bracket flange to engage a rectangular shaped support member.
Figure 15:
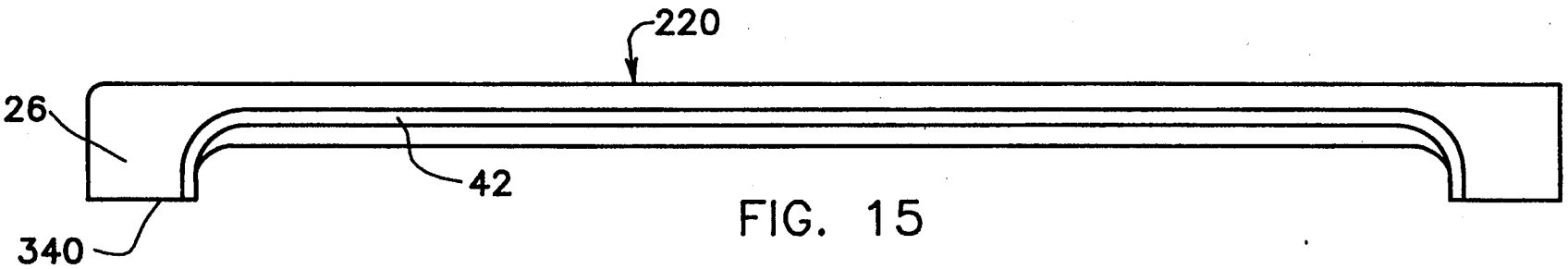
FIG. 15 is a top view showing an alternative glide runner

Mounting means, such as the brackets 18, for attachment of the longitudinal members 12 in spaced relationship to a support structure or frame 14 for supporting a container thereinbetween, are integrally formed on the distal ends of each longitudinal member 12. The brackets 18 of the preferred embodiment comprise "C-shaped" or "semi-cylindrical shaped" flanges 26 adapted for attachment to generally round tubular members such as the vertical frame support members 16 shown in FIGS. 1, 2, 5, and 8. Upon mounting, the inner surface 24 of the flanges 26 is contiguous with the exterior surface of the tubular member 16. It is contemplated that the inner surface 24 of the brackets 18 may be generally rectangular shaped, such as shown by member 120 of FIG. 14 having a flange 26 with a rectangular shaped inner surface 240; flat, such an shown by member 220 of FIG. 15 having a flange 26 with a flat surface 340; or formed for adaptation to a support member 16 having any particular shape. As shown in the preferred embodiment the flanges 26 are oriented perpendicular to the longitudinal member 12 to facilitate mounting to a vertical tubular member; however, one or both of the flanges 26 of a longitudinal member 12 may be oriented in the horizontal axis for attachment to a horizontal tubular member as shown in FIG. 13.

Figure 10:
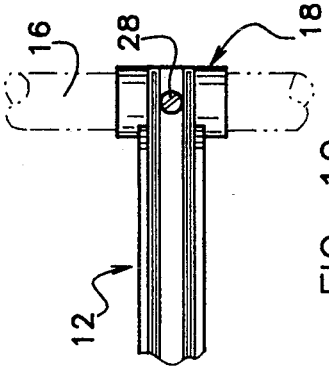
FIG. 10 is a side view showing the front end of the longitudinal member being attached to a tubular frame member by a screw extending through the bracket.
Figure 9:
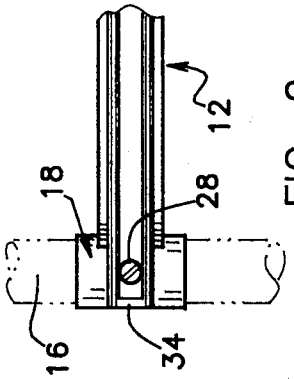
FIG. 9 is a side view showing the rear end of the longitudinal member being attached to a tubular frame member by a screw extending through the bracket.

The generally "C-shaped" holding brackets 18 on the distal ends of each longitudinal member 12 are mounted to the inside of the frame legs or support members 16. Means for securely attaching the brackets 18 to the frame support members 16 by holding members, such as screws 28, as shown in FIGS. 9 and 10, are inserted into centrally located apertures or holes 30 formed or drilled through the bracket 18, perpendicular to and through the longitudinal interior channel 20 as best shown in FIG. 3. Moreover, the screws 28 fit into a plurality of screw head sockets 32 extending horizontally through the from the longitudinal interior channel 20 toward the inner surface 24 of the flange 26. The sockets 32 are formed "molded" into the longitudinal members 12 at the time of manufacture as shown in FIG. 2; however, the sockets 32 made be formed after the molding process by drilling. The sockets 32 are recessed within the longitudinal interior channel 20 to provide a means for recessing the heads of the screws 28 below the surface of the longitudinal interior channel 20 to prevent interference of the screws 28 with the movement of the organizer container 100 slidably supported therein. Other types of holding means such as clamps, velcro, or glue could also be utilized to mount the brackets 18 to a support frame 16.

A reinforcement rib 42 extends along the exterior surface of the top and bottom of the longitudinal member 12 for providing additional structural support as shown best in FIGS. 2–6. Additional structural support can be obtained by designing the longitudinal members 12 to be thicker and heavier; however, integrally molding the reinforcement rib 42 into the longitudinal member 12 prevents deformation of the plastic during the molding operation for larger, thicker glide runner supports 10, and serves to save material, reduce costs, and provides a decorative effect to enhance the appearance of the glide runner support 10.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims.

I claim:

1. A glide runner support system comprising:

(a) a support structure for supporting a container thereinbetween;

(b) a first and a second longitudinal member, said first and said second longitudinal members having a longitudinal interior channel therein, said first and said second longitudinal members having means for attaching said member to said support structure, said first longitudinal member having opposed ends, said second longitudinal member having opposed ends, said first longitudinal member being attached to said support structure, said second longitudinal member being attached to said support structure, said first and said second longitudinal members being in a spaced apart parallel horizontal relationship opposed to each other, said longitudinal interior channel of said first longitudinal member and said longitudinal interior channel of said second longitudinal member being in a facing relationship;

wherein, for said first and said second longitudinal members, said means for attaching said member to said support structure comprises a first and a second holding bracket, said first and said second holding brackets located at said opposed ends of said first and said second longitudinal members; wherein said first and said second holding brackets of said first longitudinal member comprises a generally "C-shaped" flange, wherein said first and second holding brackets of said second longitudinal member comprises a generally "C-shaped" flange, and wherein said first and second holding brackets of said first longitudinal member are in a facing away relationship with said first and second holding brackets of said second longitudinal member;

(c) said container including means for support extending therefrom movably retained in cooperative relationship within said longitudinal interior channels of said first and said second longitudinal members.

2. The glide runner support system of claim 1, wherein said first and said second longitudinal members are flexible.

3. The glide runner support system of claim 1, wherein at least one of said first or said second holding brackets of said first or said second longitudinal members is aligned for attachment to a vertical member of said support structure.

4. The glide runner support system of claim 1, wherein at least one of said first or said second holding brackets of said first or said second longitudinal members is aligned for attachment to a horizontal member of said support structure.

5. The glide runner support system of claim 1, where at least one of said first or said second longitudinal members has said first holding bracket aligned for attachment to a vertical member of said support structure and said second holding bracket aligned for attachment to a horizontal member of said support structure.

6. The glide runner support system of claim 1, wherein said generally "C-shaped" flange has a semicylindrical shape for cooperative engagement with a round, tubular support member of said support structure.

7. The glide runner support system of claim 1, wherein said generally "C-shaped" flange has a rectangular shape for cooperative engagement with a rectangular, tubular support member of said support structure.

8. The glide runner support system of claim 1, where said first and said second longitudinal members include at least one reinforcement rib extending therealong.

9. The glide runner support system of claim 1, wherein, for said first-and said second longitudinal members, said respective longitudinal interior channel is generally centrally located within said first and said second longitudinal member.

10. The glide runner support system of claim 1, wherein, for said first and said second longitudinal members, said first and said second longitudinal members have a length, and where said respective longitudinal interior channel is a part of and extends said length of said first and said second longitudinal member.

11. The glide runner support system of claim 1, including a stop means disposed in said longitudinal interior channel of at least one of said first or said second longitudinal members.

12. The glide runner support system of claim 11, said stop means defining a member integrally formed within said interior longitudinal channel.

13. The glide runner support system of claim 11, said stop means being positioned at an end of said longitudinal interior channel.

14. The glide runner support system of claim 11, said stop means generally centrally located within said longitudinal interior channel.

15. The glide runner support system of claim 1, wherein said first longitudinal member is of unitary construction and wherein said second longitudinal member is of unitary construction.

16. The glide runner support system of claim 1, wherein said first and said second longitudinal members are bowed slightly inward toward one another.

17. The glide runner support system of claim 1, wherein, for said first and said second longitudinal members, said first holding bracket having a first aperture therethrough for insertion of a first holding member therethrough, said second holding bracket having a second aperture therethrough for insertion of a second holding member therethrough, said first and said second holding members being engagable with said support structure.

18. The glide runner support system of claim 17, wherein said first aperture has a first screw head socket and said second aperture has a second screw head socket.

19. The glide runner support system of claim 1, wherein said means for support extending from said container is a projection extending therefrom.

* * * * *

UNITED STATES PATENT AND TRADEMARK OFFICE

CERTIFICATE OF CORRECTION

PATENT NO. : 5,407,084

DATED : Apr. 18, 1995

INVENTOR(S) : Lee E. Remmers

It is certified that error appears in the above-indentified patent and that said Letters Patent is hereby corrected as shown below:

Column 1, Line 35, delete "5,367,218" and insert --2,367,218--

Column 4, Line 8, after "runner" insert --support having a bracket flange to engage a flat support member.--

Column 8, Line 5, after "first" and before "and" delete "-"

Signed and Sealed this

Seventh Day of May, 1996

Bruce Lehman

*Attest:*

BRUCE LEHMAN

*Attesting Officer*

*Commissioner of Patents and Trademarks*